US009336913B2

(12) United States Patent
Sumiya et al.

(10) Patent No.: US 9,336,913 B2
(45) Date of Patent: May 10, 2016

(54) RADIOACTIVE ORGANIC WASTE TREATMENT METHOD

(71) Applicant: Hitachi-GE Nuclear Energy, Ltd., Hitachi-shi, Ibaraki (JP)

(72) Inventors: Takako Sumiya, Hitachi (JP); Kenji Noshita, Tokyo (JP); Kazushige Ishida, Tokyo (JP); Nozomu Nagayama, Tokyo (JP); Mamoru Kamoshida, Tokyo (JP); Atsushi Yukita, Hitachi (JP)

(73) Assignee: Hitachi-GE Nuclear Energy, Ltd., Hitachi-shi (JP)

( * ) Notice: Subject to any disclaimer, the term of this patent is extended or adjusted under 35 U.S.C. 154(b) by 283 days.

(21) Appl. No.: 14/309,164

(22) Filed: Jun. 19, 2014

(65) Prior Publication Data

US 2014/0378734 A1 Dec. 25, 2014

(30) Foreign Application Priority Data

Jun. 21, 2013 (JP) ..... 2013-130070
Aug. 30, 2013 (JP) ..... 2013-179670

(51) Int. Cl.
*G21F 9/16* (2006.01)
*G21F 9/12* (2006.01)
*G21F 9/28* (2006.01)

(52) U.S. Cl.
CPC *G21F 9/12* (2013.01); *G21F 9/125* (2013.01); *G21F 9/28* (2013.01)

(58) Field of Classification Search
CPC ..... G21F 9/00; G21F 9/16; G21F 9/14; A62D 3/36
USPC ..... 588/6, 18, 318, 409
See application file for complete search history.

(56) References Cited

U.S. PATENT DOCUMENTS

| | | | |
|---|---|---|---|
| 2,752,309 | A | 6/1956 | Emmons et al. |
| 5,078,842 | A | 1/1992 | Wood et al. |
| 5,805,654 | A | 9/1998 | Wood et al. |
| 5,835,865 | A | 11/1998 | Bertholdt et al. |

FOREIGN PATENT DOCUMENTS

| | | | |
|---|---|---|---|
| DE | 44 23 398 | A1 | 1/1996 |
| JP | 57-9885 | A | 1/1982 |
| JP | 58-161898 | A | 9/1983 |
| JP | 59-46899 | A | 3/1984 |
| JP | 61-270700 | A | 11/1986 |
| JP | 63-40900 | A | 2/1988 |
| JP | 63-188796 | A | 8/1988 |
| JP | 2001-305287 | A | 10/2001 |
| JP | 2013-44588 | A | 3/2013 |

OTHER PUBLICATIONS

European Search Report dated Nov. 28, 2014 (Six (6) pages).

*Primary Examiner* — Edward Johnson
(74) *Attorney, Agent, or Firm* — Crowell & Moring LLP

(57) ABSTRACT

Disclosed is a method for treating a radioactive organic waste, the radioactive organic waste including a cation exchange resin adsorbing radionuclide ions, the method including the step of bringing the radioactive organic waste into contact with an organic acid salt aqueous solution containing an organic acid salt and whereby desorbing the radionuclide ions from the cation exchange resin, in which the organic acid salt contained in the organic acid salt aqueous solution includes a cation that is more readily adsorbable by the cation exchange resin than hydrogen ion is. This enables reduction in concentration of a radioactive substance in the radioactive organic waste and reduction in amount of a high-dose radioactive waste.

16 Claims, 7 Drawing Sheets

RADIOACTIVE ORGANIC WASTE TREATMENT METHOD

CLAIM OF PRIORITY

The present application claims priority from Japanese Patent application serial Nos. 2013-130070 and 2013-179670, each filed on Jun. 21, 2013, and Aug. 30, 2013, the contents of which are hereby incorporated by reference into this application.

BACKGROUND OF THE INVENTION

1. Field of the Invention

The present invention relates to radioactive organic waste treatment methods and systems. Specifically, it relates to methods and systems suitable for treating a radioactive organic waste such as a spent ion exchange resin and filter sludge which contain radionuclides, the radioactive organic waste being generated in nuclear power plants.

2. Description of Related Art

Reactor water cleanup systems and fuel pool cooling cleanup systems of nuclear power plants generate a radioactive organic waste such as filter sludge including a cellulosic filter aid and anion exchange resin. Such radioactive organic waste is hereinafter also referred to as "radioactive spent resin" or simply referred to as "spent resin" or "organic waste". The radioactive organic waste is stored in a storage tank over a long period of time. The radioactive organic waste is generated steadily with the operation of a nuclear power plant. And the radioactive organic waste is due to be subjected to treatments such as stabilization and volume reduction and to be ultimately disposed of by burial in the ground after the storage.

The ion exchange resins include styrene-divinylbenzene as a base material, are chemically stable, and can be stored safely over a long period of time. The ion exchange resins, however, are hardly decomposable due to their stability and generally require a thermal treatment at a high temperature in order to reduce their volume.

Exemplary methods for treating a radioactive spent ion exchange resin by a thermal decomposition (thermal treatment) can be found as a treatment method using plasma in Japanese Unexamined Patent Application Publication No. 2001-305287 (Patent Document 1); and as a treatment method using microwaves in Japanese Unexamined Patent Application Publication No. Sho 59-46899 (Patent Document 2). The treatment methods in Patent Document 1 and Patent Document 2 respectively promote volume reduction of the spent ion exchange resin.

To solve the problem, there proposed are treatment methods for the volume reduction of the radioactive spent ion exchange resin by another technique than thermal decomposition. Examples of them are as follows.

There are treatment methods of decomposing organic substances in the spent ion exchange resin with hydrogen peroxide. Typically, Japanese Unexamined Patent Application Publication No. Sho 61-270700 (Patent Document 3) describes a radioactive waste treatment method, in which the cellulosic filter sludge is hydrolyzed and liquefied with a cellulolytic enzyme to give a liquid, and the liquid is acted upon by hydrogen peroxide in the presence of an iron ion to oxidize and decompose the organic substances. Ferrous sulfate is used to give the iron ion in the working examples of this document. Japanese Unexamined Patent Application Publication No. Sho 58-161898 (Patent Document 4) discloses a method of bringing a radioactive spent ion exchange resin into contact with hydrogen peroxide in a ferric sulfate aqueous solution and whereby oxidizing and decomposing the ion exchange resin.

Japanese Unexamined Patent Application Publication No. Sho 63-40900 (Patent Document 5) describes a treatment method of the radioactive spent ion exchange resin. By the treatment method, radionuclides contained in a spent ion exchange resin are eluted with a sulfuric acid aqueous solution to remove most of the radioactive substances (radionuclides) from the spent ion exchange resin; the spent ion exchange resin is then converted into an inorganic substance and solidified by an incineration or a chemical decomposition; an eluate containing the radionuclides is incorporated with a divalent iron ion and a base to form ferrite particles; and the radionuclides are taken into the formed ferrite particles and thus separated from the eluate.

Japanese Unexamined Patent Application Publication No. Sho 63-188796 (Patent Document 6) describes a treatment method of a decontamination waste liquid. In the treatment method, a radioactive decontamination waste liquid is treated with a cation exchange resin, and whereby iron and radionuclides in the decontamination waste liquid are scavenged by the cation exchange resin and removed from the waste liquid. The decontamination waste liquid from which the radionuclides have been removed is solidified with cement in a metal drum. Independently, the iron and radionuclides scavenged by the cation exchange resin are eluted out with an organic acid (e.g., oxalic acid or formic acid) to give an eluate containing the eluted iron and radionuclides; and the eluate is given a liquid which converts the iron and radionuclides each into an oxide or hydroxide to be oxidized and decomposed. The oxide or hydroxide is separated from the eluate by a precipitation, and the separated oxide or hydroxide is stored for a radioactive decay. The eluate after the removal of iron and radionuclides becomes a clear water and reused in the nuclear power plant.

Japanese Unexamined Patent Application Publication No. Sho 57-9885 (Patent Document 7) discloses a composition for removing a metal oxide using oxalic acid and hydrazine. The technology is disclosed as not a volume reduction treatment technology, but a chemical cleaning technology relating to such volume reduction treatment.

Japanese Unexamined Patent Application Publication No. 2013-44588 (Patent Document 8) describes a treatment method for a spent resin in a nuclear power plant. The method is described as a treatment method for the volume reduction of filter sludge including a spent ion exchange resin and/or a filter aid. In the method, adsorbed radioactive metal ions are eluted out from the ion exchange resin by an action of oxalic acid (a kind of organic acids); and radionuclides included in crud including an iron oxide are dissolved and removed together with the crud, the crud being deposited on the resin surface. The organic acid (oxalic acid) for use in the treatment is decomposable typically by an oxidizing agent, and this enables the volume reduction of a waste liquid generated as a secondary waste.

SUMMARY OF THE INVENTION

The present invention provides a method for treating a radioactive organic waste, the radioactive organic waste including a cation exchange resin adsorbing radionuclide ions, the method including the step of bringing the radioactive organic waste into contact with an organic acid salt aqueous solution containing an organic acid salt and whereby desorbing the radionuclide ions from the cation exchange resin, in which the organic acid salt contained in the organic acid salt aqueous solution includes a cation that is more readily adsorbable by the cation exchange resin than hydrogen ion is.

This enables reduction in concentration of a radioactive substance in the radioactive organic waste and reduction in amount of a high-dose radioactive waste.

DETAILED DESCRIPTION OF THE PREFERRED EMBODIMENTS

Figure 1:
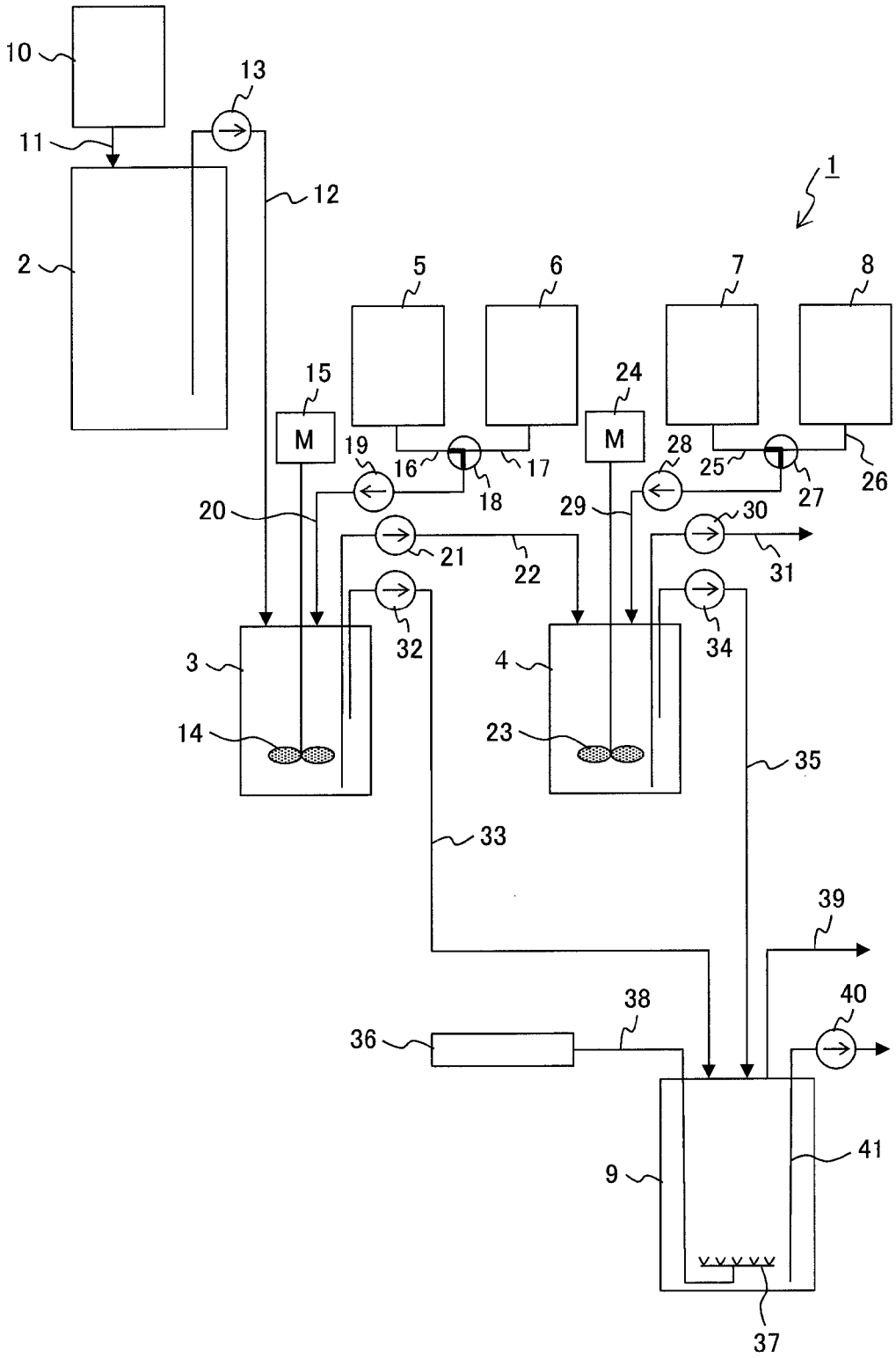
FIG. 1 is a schematic diagram illustrating a radioactive organic waste treatment system according to First Embodiment.

Disadvantages in known technologies to be improved are as follows.

The thermal decomposition treatment method in Patent Document 1 promotes the volume reduction of the spent resin. The method is, however, applied to such spent ion exchange resin containing radionuclides in a relatively high concentration. A high temperature treatment is required in order to decompose the spent resin which is chemically stable. For example, the high temperature treatment is a thermal treatment at 500° C. or high. This requires a remote control system typically for pressure reduction and atmosphere control, requires a sophisticated exhaust gas treatment system, and causes a treatment system for use in the method to have a complicated structure as a whole.

The decomposition treatment method in Patent Document 2 using hydrogen peroxide can employ a simple system, but gives a residual waste liquid containing a large amount of sulfate group as a result of the treatment. Hence, the method requires a neutralization treatment. Therefore, the volume reduction performance of the method is lower than the thermal treatment method using the plasma.

The volume reduction treatment by decomposition with hydrogen peroxide as in Patent Document 3 and Patent Document 4 gives a residual radioactive waste liquid containing a large amount of sulfate group derived from the exchange group of the ion exchange resin. Hence, the method requires the neutralization treatment. Therefore, the volume reduction performance of the radioactive waste by the method is lower than the thermal treatment method.

The spent ion exchange resin treatment method in Patent Document 5 employs an aqueous sulfuric acid solution as a desirable eluent for eluting radionuclides from the spent ion exchange resin. The method therefore disadvantageously suffers from the formation of a large amount of waste sulfuric acid. This requires a treatment such as collection and reuse of sulfuric acid typically by electrodialysis.

When iron and radionuclides adsorbed by a cation exchange resin are eluted out using an organic acid (e.g., oxalic acid or formic acid) as in the decontamination waste liquid treatment method in Patent Document 6, the radionuclides are insufficiently desorbed from the cation exchange resin and remain partially in the cation exchange resin. This has been experimentally verified by the present inventors.

The composition for the removal of the metal oxide in Patent Document 7 is adapted to be used not in the volume reduction treatment of the spent resin, but in the cleaning of a metal material.

The nuclear-power-plant spent resin treatment method using oxalic acid alone as described in Patent Document 8 requires a large amount of an oxalic acid solution because the method performs crud dissolution and elusion of adsorbed radioactive metal ions from the resin concurrently.

An object of the present invention is to reduce a concentration of a radioactive substance in a radioactive organic waste and to reduce an amount of a high-dose radioactive waste.

Embodiments of the present invention will be illustrated below.

First Embodiment

Initially, First Embodiment will be illustrated with reference to FIGS. 1 and 2.

FIG. 1 illustrates the structure of a radioactive organic waste treatment system according to First Embodiment.

A radioactive organic waste treatment system 1 according to the present embodiment has a first cleaning tank 3, a second cleaning tank 4, an organic acid tank 5, a transfer water tank 6, an organic acid salt tank 7, a transfer water tank 8, and a cleaning waste liquid treatment tank 9.

The first cleaning tank 3 includes an agitating equipment that includes agitator blades 14 and a motor 15. The agitator blades 14 and the motor 15 are connected with a rotating shaft. An organic waste supply pipe 12 equipped with a transfer pump 13 is connected between a high-dose resin storage tank 2 and the first cleaning tank 3. An organic acid supply pipe 16 is connected between a bottom of the organic acid tank 5 and a selector valve 18; whereas a transfer water supply pipe 17 is connected between the bottom of the transfer water tank 6 and the selector valve 18. The organic acid tank 5 is charged with an oxalic acid aqueous solution; whereas the transfer water tank 6 is filled with water acting as transfer water. A liquid supply pipe 20 is connected between the selector valve 18 and the first cleaning tank 3 and is equipped with a transfer pump 19.

The second cleaning tank 4 includes agitating equipment that includes agitator blades 23 and a motor 24. The agitator blades 23 and the motor 24 are connected with a rotating shaft. An organic waste transfer pipe 22 equipped with a transfer pump 21 is connected between the first cleaning tank 3 and the second cleaning tank 4. An organic acid salt supply pipe 25 is connected between the bottom of the organic acid salt tank 7 and a selector valve 27; whereas a transfer water supply pipe 26 is connected between the bottom of the transfer water tank 8 and the selector valve 27. The organic acid tank 5 is filled with an ammonium formate aqueous solution; whereas the transfer water tank 8 is filled with water acting as transfer water.

A liquid supply pipe 29 is connected between the selector valve 27 and the second cleaning tank 4 and is equipped with a transfer pump 28. An organic waste transfer pipe 31 is inserted into the second cleaning tank 4 and one end of the organic waste transfer pipe 31 extends to the vicinity of the bottom of the second cleaning tank 4. The organic waste transfer pipe 31 is equipped with a transfer pump 30.

An ozone injection pipe 37 having a multiplicity of nozzles is arranged at the bottom in the cleaning waste liquid treatment tank 9. The ozone injection pipe 37 is connected via an ozone supply pipe 38 to an ozone supplier 36. A waste liquid transfer pipe 33 is mounted into the first cleaning tank 3 and is connected to the cleaning waste liquid treatment tank 9. The waste liquid transfer pipe 33 is equipped with a transfer pump 32. A waste liquid transfer pipe 35 is mounted into the second cleaning tank 4 and is connected to the cleaning waste liquid treatment tank 9. The waste liquid transfer pipe 35 is equipped with a transfer pump 34. A gas exhaust pipe 39 is connected to the cleaning waste liquid treatment tank 9. A waste liquid discharge pipe 41 is equipped with a transfer pump 40 and is mounted into the cleaning waste liquid treatment tank 9.

A nuclear power plant generates a radioactive organic waste typically in a reactor water cleanup system and a fuel pool cooling cleanup system. The radioactive organic waste includes filter sludge including a cellulosic filter aid and an ion exchange resin. The radioactive organic waste is stored in the high-dose resin storage tank 2 over a long period of time. A transfer water tank 10 filled with water is connected via a transfer water supply pipe 11 to the high-dose resin storage tank 2. The radioactive organic waste stored in the high-dose resin storage tank 2 includes crud removed from cooling water typically in the reactor water cleanup system and the fuel pool cooling cleanup system. The crud includes radionuclides such as cobalt-60. The ion exchange resin stored in the high-dose resin storage tank 2 includes adsorbed ions of radionuclides such as cobalt-60, cesium-137, carbon-14 and chlorine-36.

Figure 2:
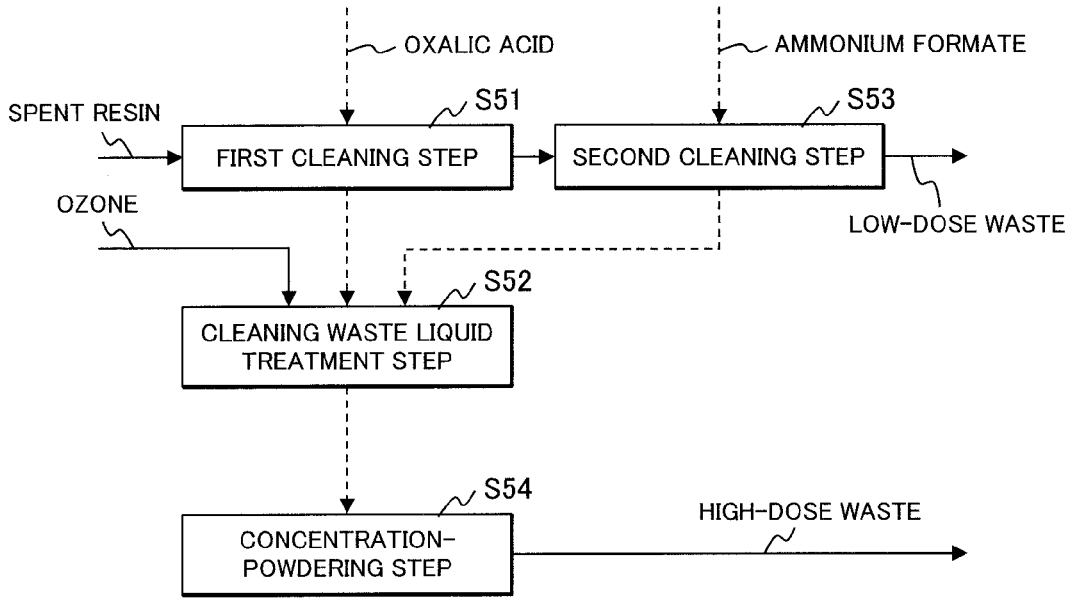
FIG. 2 is a flow chart illustrating a procedure of a radioactive organic waste treatment method according to First Embodiment.

FIG. 2 illustrates a procedure of a radioactive organic waste treatment method according to the present embodiment using the radioactive organic waste treatment system 1 in FIG. 1. In the following explanation, reference signs indicated by numbers alone correspond to the reference signs in FIG. 1.

Initially, a step of supplying the radioactive organic waste from the high-dose resin storage tank 2 to the first cleaning tank 3 will be illustrated. The step is performed upstream from a first cleaning step S51 in FIG. 2.

A boiling water nuclear power plant generates filter sludge (radioactive organic waste) including a cellulosic filter aid and an ion exchange resin typically from the reactor water cleanup system and fuel pool cooling cleanup system. The filter sludge is stored in the high-dose resin storage tank 2 over a long period of time. To treat the radioactive organic waste stored in the high-dose resin storage tank 2, the water in the transfer water tank 10 is supplied through the transfer water supply pipe 11 into the high-dose resin storage tank 2 to convert the radioactive organic waste in the high-dose resin storage tank 2 into slurry that is easily transferable.

The transfer pump 13 is driven to supply the slurry containing the radioactive organic waste from the high-dose resin storage tank 2 through the organic waste supply pipe 12 to the first cleaning tank 3. The transfer pump 13 is stopped so as to stop the supply of slurry to the first cleaning tank 3 at the time when the level of the slurry containing the radioactive organic waste reaches a predetermined level in the first cleaning tank 3. The transfer pump 32 is then driven to supply water contained in the slurry from the first cleaning tank 3 through the waste liquid transfer pipe 33 into the cleaning waste liquid treatment tank 9. The water is handled as a waste liquid. The waste liquid brought into the cleaning waste liquid treatment tank 9 is treated in an after-mentioned cleaning waste liquid treatment step S52 as with a cleaning waste liquid. The transfer pump 40 is driven to bring the waste liquid through the waste liquid discharge pipe 41 to a storage tank. The transfer pump 32 is stopped upon the completion of transfer of water contained in the slurry in the first cleaning tank 3.

The first cleaning step S51 (an organic acid treatment process) is performed thereafter. The first cleaning step S51 mainly performs the dissolution of crud such as iron oxide by injecting an organic acid. The crud has been transferred together with the radioactive organic waste to the first cleaning tank 3. The organic acid is used for reasons as follows.

Such organic acid includes carbon, hydrogen, oxygen and nitrogen as main constitutive elements and does not give a non-volatile residue in a waste liquid when an organic acid aqueous solution generated as a cleaning waste liquid in the first cleaning step S51 is treated by oxidization with ozone (an organic acid oxidization treatment process). The organic acid for use herein is preferably at least one selected typically from formic acid, oxalic acid, carbonic acid, acetic acid, and citric acid.

The organic acid tank 5 is filled with an aqueous solution of oxalic acid as the organic acid. The oxalic acid aqueous solution may be a saturated aqueous solution and may have an oxalic acid concentration of about 0.8 mol/L. The first cleaning step S51 performs operations as follows.

The selector valve 18 is operated to allow the organic acid supply pipe 16 to communicate with the liquid supply pipe 20, and the transfer pump 19 is driven. The oxalic acid aqueous solution in the organic acid tank 5 is supplied through the organic acid supply pipe 16 and the liquid supply pipe 20 to the first cleaning tank 3. In this process, the water in the transfer water tank 6 is not supplied to the first cleaning tank 3 because the transfer water supply pipe 17 does not communicate with the liquid supply pipe 20. The transfer pump 19 is stopped so as to stop the supply of the oxalic acid aqueous solution to the first cleaning tank 3 at the time when the liquid level of the oxalic acid aqueous solution in the first cleaning tank 3 reaches a preset level. The oxalic acid aqueous solution may be supplied into the first cleaning tank 3 in an amount 10 times the amount of the radioactive organic waste in the first cleaning tank 3.

A heater (not shown) is arranged on an outer surface of the first cleaning tank 3 and heats the oxalic acid aqueous solution in the first cleaning tank 3 to a temperature typically of 60° C. The temperature of the oxalic acid aqueous solution is held at 60° C. by controlling the thermal dose by the heater. While holding the temperature at 60° C., the motor 15 is driven to rotate the agitator blades 14 to thereby agitate the radioactive organic waste and the oxalic acid aqueous solution with each other in the first cleaning tank 3. The radioactive organic waste is immersed in the oxalic acid aqueous solution for duration typically of 6 hours with agitation in the first cleaning tank 3. Thus, the crud mixed with the radioactive organic waste is dissolved by the action of oxalic acid in the first cleaning tank 3. The crud dissolution allows the radionuclides such as cobalt-60 contained in the crud to migrate into the oxalic acid solution. An iron component in the crud, when dissolved, forms iron (II) ion. The iron (II) ion may react with oxalic acid to form iron oxalate, and the iron oxalate might precipitate. To suppress the formation of iron oxalate, a small amount of an oxidizing agent (e.g., hydrogen peroxide) that converts the iron(II) ion to iron(III) ion may be fed to the first cleaning tank 3 according to necessity.

In the first cleaning step S51, the ion exchange resin forming part of the radioactive organic waste is immersed in oxalic acid as the organic acid. This allows part of the adsorbed radionuclides to be desorbed from the ion exchange resin. Specifically, oxalic acid dissociates into hydrogen ion and oxalic acid ion, and radionuclides adsorbed by a cation exchange resin and an anion exchange resin undergo ion exchange with the hydrogen ion and oxalic acid ion, respectively, and are desorbed from the ion exchange resins.

The first cleaning step S51 is completed upon the lapse of 6 hours, i.e., the immersion time of the radioactive organic waste in the oxalic acid aqueous solution in the first cleaning tank 3. The motor 15 and the heating of the first cleaning tank 3 by the heater are respectively stopped, and the transfer pump 32 is driven to supply, as a cleaning waste liquid, the oxalic acid aqueous solution containing the radionuclides from the first cleaning tank 3 through the waste liquid transfer pipe 33 into the cleaning waste liquid treatment tank 9. The transfer pump 32 is stopped upon the completion of the transfer of the oxalic acid aqueous solution from the first cleaning tank 3 to the cleaning waste liquid treatment tank 9.

A cleaning waste liquid treatment step S52 is performed after the completion of the transfer of the oxalic acid aqueous solution to the cleaning waste liquid treatment tank 9. In the cleaning waste liquid treatment step S52, ozone is supplied from the ozone supplier 36 through the ozone supply pipe 38 to the ozone injection pipe 37 for a predetermined time and is injected through the multiplicity of nozzles formed in the ozone injection pipe 37 into the oxalic acid aqueous solution in the cleaning waste liquid treatment tank 9. Oxalic acid contained as an organic component in the oxalic acid aqueous solution is decomposed by the injected ozone. The oxalic acid reacts with ozone and is decomposed into carbon dioxide and water. The carbon dioxide and the remainder of ozone injected into the cleaning waste liquid treatment tank 9 are supplied through the gas exhaust pipe 39 to an off-gas treatment equipment (not shown), and a radioactive gas contained in the gas discharged to the gas exhaust pipe 39 is removed by the off-gas treatment equipment.

After the stop of ozone supply, the transfer pump 40 is driven to discharge the radionuclide-containing waste liquid in the cleaning waste liquid treatment tank 9 to the waste liquid discharge pipe 41 and is temporarily stored in a storage tank (not shown). A concentration-powdering step S54 as follows is then performed. The waste liquid in the storage tank is powdered typically with a thin film dryer, housed in a metal drum, and solidified with cement. Such radioactive solidified article is handled as a high-dose waste and is stored in a predetermined storage area. The radioactive waste liquid discharged from the cleaning waste liquid treatment tank 9 may be concentrated by heating, thus reduced in volume, charged into a metal drum, and solidified with cement.

After the completion of the discharge of the oxalic acid aqueous solution from the first cleaning tank 3 to the cleaning waste liquid treatment tank 9, the selector valve 18 is operated to allow the transfer water supply pipe 17 to communicate with the liquid supply pipe 20; and the transfer pump 19 is driven to supply, as transfer water, water in the transfer water tank 8 through the transfer water supply pipe 17 and the liquid supply pipe 20 to the first cleaning tank 3. In this process, the oxalic acid aqueous solution in the organic acid tank 5 is not supplied to the first cleaning tank 3 because the organic acid supply pipe 16 does not communicate with the liquid supply pipe 20. The transfer pump 19 is stopped so as to stop the water supply to the first cleaning tank 3 at the time when a predetermined amount of water is supplied from the transfer water tank 8 to the first cleaning tank 3, and the water level in the first cleaning tank 3 reaches a preset level.

The motor 15 is driven to rotate the agitator blades 14 to thereby agitate the radioactive organic waste and the water with each other in the first cleaning tank 3. Thus, the radioactive organic waste is converted into slurry. The transfer pump 21 is driven to supply the slurry containing the radioactive organic waste from the first cleaning tank 3 through the organic waste transfer pipe 22 to the second cleaning tank 4. When the slurry containing the radioactive organic waste is transferred from the first cleaning tank 3, the water amount in the first cleaning tank 3 reduces, and this may impede the transfer of the radioactive organic waste from the first cleaning tank 3. In this case, the transfer pump 19 may be driven according to necessity so as to supply water from the transfer water tank 8 into the first cleaning tank 3. The transfer pump 21 is stopped and the transfer pump 34 is driven upon the completion of the transfer of the radioactive organic waste from the first cleaning tank 3 to the second cleaning tank 4. The water in the second cleaning tank 4 is then discharged through the waste liquid transfer pipe 35 to the cleaning waste liquid treatment tank 9. The water brought from the second cleaning tank 4 to the cleaning waste liquid treatment tank 9 is treated in the cleaning waste liquid treatment step S52 as with the cleaning waste liquid. The transfer pump 40 is then driven to bring the treated water through the waste liquid discharge pipe 41 to a storage tank.

A second cleaning step S53 (an organic acid salt treatment process) is performed when the transfer pump 34 is stopped so as to complete the water discharge from the second cleaning tank 4 to the cleaning waste liquid treatment tank 9. The second cleaning step S53 employs an organic acid salt to more efficiently desorb radionuclides adsorbed by the ion exchange resin (e.g., a cation exchange resin). The organic acid salt for use in the second cleaning step S53 is desirably one capable of dissociating in an aqueous solution to form a cation that is more readily adsorbable by a cation exchange resin than the hydrogen ion is. Specifically, the organic acid salt is preferably such an organic acid salt that includes carbon, hydrogen, oxygen, and nitrogen as main constitutive elements and does not form a non-volatile residue in a waste liquid when the organic acid salt aqueous solution as a cleaning waste liquid after the completion of the second cleaning step S53 is treated by oxidation typically with ozone (an organic acid salt oxidization treatment process). The organic acid salt is preferably a salt of an organic acid, where the salt is selected typically from ammonium salt, barium salt, and cesium salt; and the organic acid is selected typically from formic acid, oxalic acid, carbonic acid, acetic acid, and citric acid. The ammonium salt is decomposed into nitrogen gas and water by the oxidization treatment and can contribute to reduction in amount of radioactive waste more than barium salt and cesium salt do. The ammonium salt, barium salt, or cesium salt of formic acid, oxalic acid, carbonic acid, acetic acid, or citric acid dissociates in the aqueous solution into $NH^{4+}$, $Ba^{2+}$, or $Cs^{+}$, respectively. The cations $NH^{4+}$, $Ba^{2+}$, and $Cs^{+}$ are more readily adsorbable by the cation exchange resin than hydrogen ion is.

The organic acid salt tank 7 is filled with an aqueous solution of ammonium formate as the organic acid salt. The ammonium formate aqueous solution may have an ammonium formate concentration of 1.2 mol/L. The second cleaning step S53 performs operations as follows. The selector valve 27 is operated to allow the organic acid salt supply pipe 25 to communicate with the liquid supply pipe 29; and the transfer pump 28 is driven. The ammonium formate aqueous solution is thus supplied from the organic acid salt tank 7 through the organic acid salt supply pipe 25 and the liquid supply pipe 29 to the second cleaning tank 4. In this process, the water in the transfer water tank 8 is not supplied to the second cleaning tank 4 because the transfer water supply pipe 26 does not communicate with the liquid supply pipe 29. The transfer pump 28 is stopped so as to stop the supply of the ammonium formate aqueous solution to the second cleaning tank 4 at the time when the liquid level of the ammonium formate aqueous solution in the second cleaning tank 4 reaches a preset level.

A heater (not shown) is arranged on an outer surface of the second cleaning tank 4 and heats the ammonium formate aqueous solution in the second cleaning tank 4 to a temperature typically of 60° C. The temperature of the ammonium formate aqueous solution is held at 60° C. by controlling the thermal dose applied by the heater. While holding the temperature at 60° C., the motor 24 is driven to rotate the agitator blades 23 to thereby agitate the radioactive organic waste and the ammonium formate aqueous solution with each other in the second cleaning tank 4. While being agitated, the radioactive organic waste is immersed in the ammonium formate aqueous solution in the second cleaning tank 4 for duration typically of 2 hours. The radioactive organic waste includes a cation exchange resin adsorbing radionuclide ions. The adsorbed radionuclide ions are exchanged with ammonium ion and efficiently desorbed into the ammonium formate aqueous solution in the second cleaning tank 4, where the ammonium ion is present in the ammonium formate aqueous solution and is more readily adsorbable by the cation exchange resin than hydrogen ion is. This remarkably reduces the amount of radionuclides adsorbed by the cation exchange resin.

The second cleaning step S53 is completed upon the lapse of the immersion time, i.e., 2 hours, of the radioactive organic waste in the ammonium formate aqueous solution in the second cleaning tank 4. The motor 24 and the heating of the second cleaning tank 4 by the heater are respectively stopped, the transfer pump 34 is driven to supply, as a cleaning waste liquid, the ammonium formate aqueous solution containing radionuclides from the second cleaning tank 4 through the waste liquid transfer pipe 35 into the cleaning waste liquid treatment tank 9. The transfer pump 34 is stopped upon the completion of the transfer of the ammonium formate aqueous solution from the second cleaning tank 4 to the cleaning waste liquid treatment tank 9.

The cleaning waste liquid treatment step S52 is performed after the completion of the transfer of the ammonium formate aqueous solution to the cleaning waste liquid treatment tank 9. In the cleaning waste liquid treatment step S52, ozone is supplied by the ozone supplier 36 to the ozone injection pipe 37 for a predetermined time and is injected into the ammonium formate aqueous solution in the cleaning waste liquid treatment tank 9. Thus, ammonium formate contained as an organic component in the ammonium formate aqueous solution is decomposed by ozone. The ammonium formate reacts with ozone and is decomposed into carbon dioxide (gas), nitrogen gas, and water. Such gases are supplied through the gas exhaust pipe 39 to the off-gas treatment equipment (not shown).

After the stop of ozone supply, the transfer pump 40 is driven to discharge the waste liquid containing radionuclides from the cleaning waste liquid treatment tank 9 to the waste liquid discharge pipe 41. The radionuclide-containing waste liquid is then temporarily stored in a storage tank (not shown). The concentration-powdering step S54 is then performed, and the waste liquid in the storage tank is powdered typically with a thin film dryer, housed in a metal drum, and solidified with cement. The resulting radioactive solidified article is also handled as a high-dose waste and stored in a predetermined storage area. After ammonium formate is decomposed by ozone in the cleaning waste liquid treatment tank 9, a radioactive waste liquid is discharged from the cleaning waste liquid treatment tank 9. The radioactive waste liquid may be concentrated by heating and reduced in volume, and then charged into a metal drum and solidified with cement.

After the completion of the transfer of the ammonium formate aqueous solution to the cleaning waste liquid treatment tank 9, the selector valve 27 is operated to allow the transfer water supply pipe 26 to communicate with the liquid supply pipe 29; and the transfer pump 28 is driven to supply water from the transfer water tank 8 to the second cleaning tank 4. The transfer pump 28 is stopped so as to stop the water supply from the transfer water tank 8 to the second cleaning tank 4 after a predetermined amount of water is supplied to the second cleaning tank 4. The agitator blades 23 are rotated to agitate the radioactive organic waste and the water with each other in the second cleaning tank 4 to thereby form slurry containing the radioactive organic waste. The transfer pump 30 is driven to discharge the slurry containing the radioactive organic waste after cleaning from the second cleaning tank 4 to the organic waste transfer pipe 31. The radioactive organic waste after cleaning and being discharged to the organic waste transfer pipe 31 includes substantially no crud, contains radionuclide ions adsorbed by the cation exchange resin in a still reduced amount, and thereby has a remarkably lower radiation dose rate.

The radioactive organic waste discharged to the organic waste transfer pipe 31 is temporarily stored in a storage tank (not shown). The radioactive organic waste taken out from the storage tank is incinerated typically in an incinerator. Ash formed by incineration is solidified with cement in a metal drum. The resulting solidified article is handled as a low-level radioactive waste.

In the present embodiment, the first cleaning step S51 may employ one selected from formic acid, carbonic acid, acetic acid, and citric acid instead of oxalic acid; whereas the second cleaning step S53 may employ an ammonium salt, barium salt, or cesium salt of one selected from oxalic acid, carbonic acid, acetic acid, and citric acid; or barium salt or cesium salt of formic acid, instead of ammonium formate.

The present embodiment enables reduction in amount of a high-dose radioactive waste and reduction in concentration of a radioactive substance contained in a radioactive organic waste. This is because the first cleaning step S51 employs the oxalic acid aqueous solution and thereby enables the dissolution of an iron oxide component mixed with the radioactive organic waste; and the second cleaning step S53 exchanges adsorbed radionuclide ions in the cation exchange range with ammonium ion contained in the ammonium formate aqueous solution, where the cation exchange resin is present as the radioactive organic waste. Even after the treatment with the oxalic acid aqueous solution, some radionuclide ions may be not desorbed from, but still adsorbed by the cation exchange resin. Particularly in this case, the present embodiment can efficiently desorb the residual adsorbed radionuclide ions from the cation exchange resin by bringing the ammonium formate aqueous solution into contact with the radioactive organic waste.

Specifically, the present embodiment utilizes the action of an organic acid salt aqueous solution such as the ammonium formate aqueous solution and can desorb a larger amount of adsorbed radionuclide ions from the cation exchange resin than that of the method in Patent Document 6 in which adsorbed radionuclide ions are desorbed from the cation exchange resin by the organic acid aqueous solution (e.g., the oxalic acid aqueous solution).

The present embodiment can still reduce the concentration of a radioactive substance contained in the radioactive organic waste such as the cation exchange resin and can reduce the amount of a high-dose radioactive waste (amount of the cation exchange resin adsorbing radionuclide ions). In addition, the present embodiment employs the oxidization treatment to decompose organic components in the cleaning waste liquid and performs concentration or dry powdering of the residual waste liquid. The organic components are oxalic acid contained in the oxalic acid aqueous solution; and ammonium formate contained in the ammonium formate aqueous solution. Thus, the embodiment can still further reduce the amount of the high-dose radioactive waste.

In an embodiment of the radioactive organic waste treatment system 1, the liquid supply pipe 29 and the organic waste transfer pipe 31 may be connected to the first cleaning tank 3 without employing the second cleaning tank 4, the transfer pumps 21 and 34, and the organic waste transfer pipes 22 and 35. When the radioactive organic waste treatment system 1 having the structure according to this embodiment is employed, the first cleaning step S51 and the second cleaning step S53 can be performed by supplying the radioactive organic waste from the high-dose resin storage tank 2 into the first cleaning tank 3; and then supplying the oxalic acid aqueous solution and the ammonium formate aqueous solution sequentially to the first cleaning tank 3. The radioactive organic waste treatment system can undergo size reduction because of not using the second cleaning tank 4, the transfer pumps 21 and 34, and the organic waste transfer pipes 22 and 35. In addition, the system can perform the radioactive organic waste treatment in a shorter time because the system eliminates the need of transferring the radioactive organic waste from the first cleaning tank 3 to the second cleaning tank 4.

Second Embodiment

A radioactive organic waste treatment method according to Second Embodiment will be illustrated below as another preferred embodiment of the present invention. The radioactive organic waste treatment method according to the present embodiment may be adapted to the treatment of a radioactive organic waste generated in a boiling water nuclear power plant.

Figure 3:
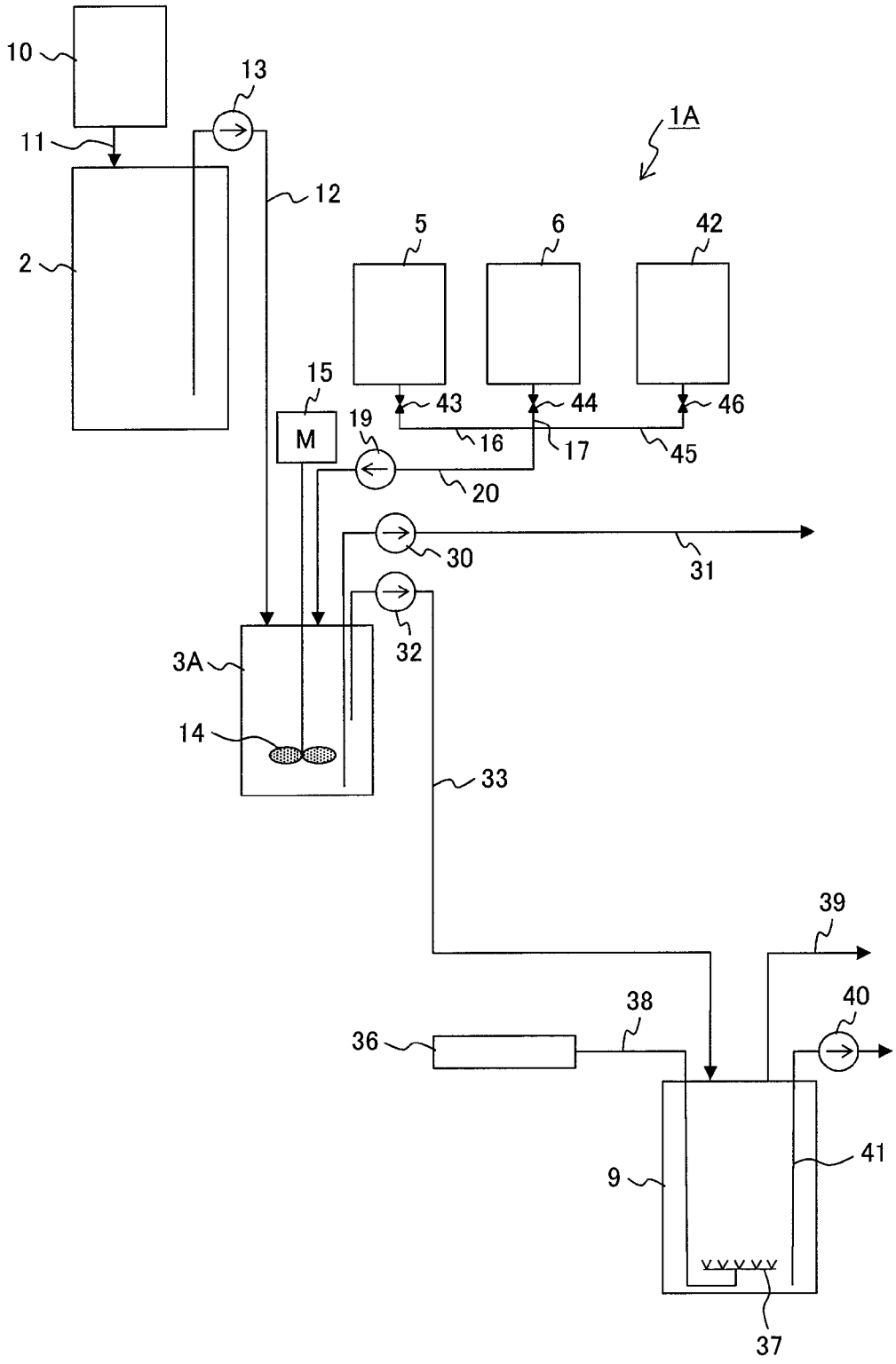
FIG. 3 is a schematic diagram illustrating a radioactive organic waste treatment system according to Second Embodiment.

FIG. 3 illustrates a radioactive organic waste treatment system for use in the present embodiment.

The radioactive organic waste treatment system 1A in FIG. 3 corresponds to the radioactive organic waste treatment system 1 in FIG. 1, except for not using the second cleaning tank 4, the transfer pumps 21 and 34, and the organic waste transfer pipes 22 and 35; arranging a cleaning tank 3A instead of the first cleaning tank 3 in FIG. 1; and arranging an aqueous ammonia supply tank 42 instead of the organic acid salt tank 7 in FIG. 1. The aqueous ammonia supply tank 42 is filled with aqueous ammonia as a basic aqueous solution.

How the radioactive organic waste treatment system 1A differs from the radioactive organic waste treatment system 1 in FIG. 1 will be specifically described below.

An organic acid supply pipe 16 is connected to the bottom of the organic acid tank 5. A transfer water supply pipe 17 is connected to the bottom of the transfer water tank 6. An aqueous ammonia supply pipe 45 is connected to the bottom of aqueous ammonia supply tank 42. The pipes 16, 17, and 45 are connected to a liquid supply pipe 20 that is in turn connected to the cleaning tank 3A. The pipes 16, 17, and 45 are equipped with on-off valves 43, 44, and 46, respectively. An organic waste transfer pipe 31 is connected to the cleaning tank 3A. The other structure (configuration) of the radioactive organic waste treatment system 1A is the same as with the radioactive organic waste treatment system 1 in FIG. 1.

The radioactive organic waste treatment method according to the present embodiment using the radioactive organic waste treatment system 1A will be illustrated below.

According to the present embodiment, the first cleaning step S51 and the second cleaning step S53 are performed in the cleaning tank 3A. A radioactive organic waste as slurry is supplied from the high-dose resin storage tank 2 through the organic waste supply pipe 12 to the cleaning tank 3A. The transfer pump 32 is driven to discharge water in the cleaning tank 3A though the waste liquid transfer pipe 33 to the cleaning waste liquid treatment tank 9, as in First Embodiment. After the discharge of the water from the cleaning tank 3A, the transfer pump 32 is stopped, the on-off valve 43 is opened, and the transfer pump 19 is driven to supply the oxalic acid aqueous solution from the organic acid tank 5 into the cleaning tank 3A. After the supply of a predetermined amount of the oxalic acid aqueous solution to the cleaning tank 3A, the on-off valve 43 is closed and the transfer pump 19 is stopped so as to stop the supply of the oxalic acid aqueous solution to the cleaning tank 3A.

The agitator blades 14 are rotated to start agitation of the oxalic acid aqueous solution and the radioactive organic waste with each other in the cleaning tank 3A; the oxalic acid aqueous solution is heated to 60° C.; and the first cleaning step S51 is started. The radioactive organic waste is immersed in the oxalic acid aqueous solution for 6 hours in the cleaning tank 3A, and thereby crud mixed with the radioactive organic waste is dissolved by the action of oxalic acid. In addition, some of adsorbed radionuclide ions are desorbed from the cation exchange resin.

After the lapse of 6 hours, the on-off valve 46 is opened, and the transfer pump 19 is driven. The aqueous ammonia is supplied from the aqueous ammonia supply tank 42 through the liquid supply pipe 20 into the cleaning tank 3A. In the cleaning tank 3A, the oxalic acid aqueous solution is neutralized with the aqueous ammonia and thereby forms ammonium oxalate as an organic acid salt. This results in immersion of the radioactive organic waste in an ammonium oxalate aqueous solution in the cleaning tank 3A, and the second cleaning step S53 is thus started. The transfer pump 19 is stopped and the on-off valve 46 is closed after the supply of a predetermined amount of the aqueous ammonia to the cleaning tank 3A.

A part of the radioactive organic waste is a cation exchange resin adsorbing radionuclide ions. The adsorbed radionuclide ions are exchanged with ammonium ion in the ammonium oxalate aqueous solution and desorbed into the ammonium oxalate aqueous solution, as in First Embodiment. The step of immersing the radioactive organic waste in the ammonium oxalate aqueous solution may be performed for 2 hours. The desorption of the adsorbed radionuclide ions from the cation exchange resin is continuously performed during the step, and the amount of the radionuclide ions adsorbed by the cation exchange resin is significantly reduced.

The second cleaning step S53 is completed upon the completion of the immersion of the radioactive organic waste in the ammonium oxalate aqueous solution for 2 hours. At this time, the rotation of the agitator blades 14 is stopped, and the transfer pump 32 is driven to transfer the ammonium oxalate aqueous solution from the cleaning tank 3A to the cleaning waste liquid treatment tank 9. Ozone is supplied to the ammonium oxalate aqueous solution in the cleaning waste liquid treatment tank 9 to decompose ammonium oxalate into nitrogen gas, carbon dioxide gas, and water.

After the completion of the cleaning waste liquid treatment step S52 by the ozone supply into the cleaning waste liquid treatment tank 9, a waste liquid is discharged from the cleaning waste liquid treatment tank 9 to the waste liquid discharge pipe 41 and temporarily stored in a storage tank (not shown). The waste liquid in the storage tank is powdered typically with a thin film dryer, housed in a metal drum, and solidified with cement.

The present embodiment offers advantageous effects as given by First Embodiment.

In addition, the radioactive organic waste treatment system 1A for use in the present embodiment can have a size smaller than that of the radioactive organic waste treatment system 1. This is because the system 1A does not require the second cleaning tank 4, the transfer pumps 21 and 34, and the organic waste transfer pipes 22 and 35. The present embodiment enables the treatment of the radioactive organic waste using the downsized radioactive organic waste treatment system 1A. The present embodiment can perform the radioactive organic waste treatment in a shorter time. This is because the present embodiment can perform the first cleaning step S51 and the second cleaning step S53 both in the cleaning tank 3A and, unlike First Embodiment, does not require the transfer of the radioactive organic waste from the first cleaning tank 3 to the second cleaning tank 4.

In addition, the present embodiment can perform the radioactive organic waste treatment in a still shorter time. The reason is as follows. According to the present embodiment, aqueous ammonia is added to the oxalic acid aqueous solution in the cleaning tank 3A after the completion of the first cleaning step S51. The oxalic acid aqueous solution is thereby neutralized and forms an ammonium oxalate aqueous solution as an organic acid salt aqueous solution. This eliminates the need of the transfer of the oxalic acid aqueous solution acting as the organic acid aqueous solution from the cleaning tank 3A to the cleaning waste liquid treatment tank 9. This also eliminates the need of the cleaning waste liquid treatment step S52 for an oxalic acid aqueous solution in the cleaning waste liquid treatment tank 9.

In another embodiment, a formic acid aqueous solution may be employed as the organic acid aqueous solution for use in the first cleaning step S51; and an ammonium formate aqueous solution may be employed as the organic acid salt aqueous solution for use in the second cleaning step S53. Even this embodiment can be performed as with the present embodiment. Specifically, after the completion of the first cleaning step S51, aqueous ammonia is added to the formic acid aqueous solution in the cleaning tank 3A in which the radioactive organic waste is immersed; and an ammonium formate aqueous solution is formed as the organic acid salt aqueous solution in the cleaning tank 3A as a result of formic acid neutralization. The second cleaning step S53 for the radioactive organic waste is performed using the ammonium formate aqueous solution in the cleaning tank 3A.

According to the present embodiment, the organic acid for use in the first cleaning step S51 may correspond to (be identical to) the base component of the organic acid salt (formic acid ion moiety of formic acid, or oxalic acid ion moiety of oxalic acid) for use in the second cleaning step S53. In this case, the solid-liquid separation (separation of the radioactive organic waste from the organic acid aqueous solution) is not performed after the first cleaning step S51, but the organic acid in contact with the radioactive waste liquid is neutralized with a basic aqueous solution (e.g., aqueous ammonia) to form an organic acid salt aqueous solution, and the formed organic acid salt aqueous solution is used to clean the radioactive organic waste in the second cleaning step S53. As used herein the term "base component" refers to a Broensted base, namely, a component that receives hydrogen ion.

Third Embodiment

A radioactive organic waste treatment method according to Third Embodiment will be illustrated below as still another preferred embodiment of the present invention. The radioactive organic waste treatment method according to the present embodiment may be adapted to the treatment of a radioactive organic waste generated in a pressurized water nuclear power plant.

Figure 4:
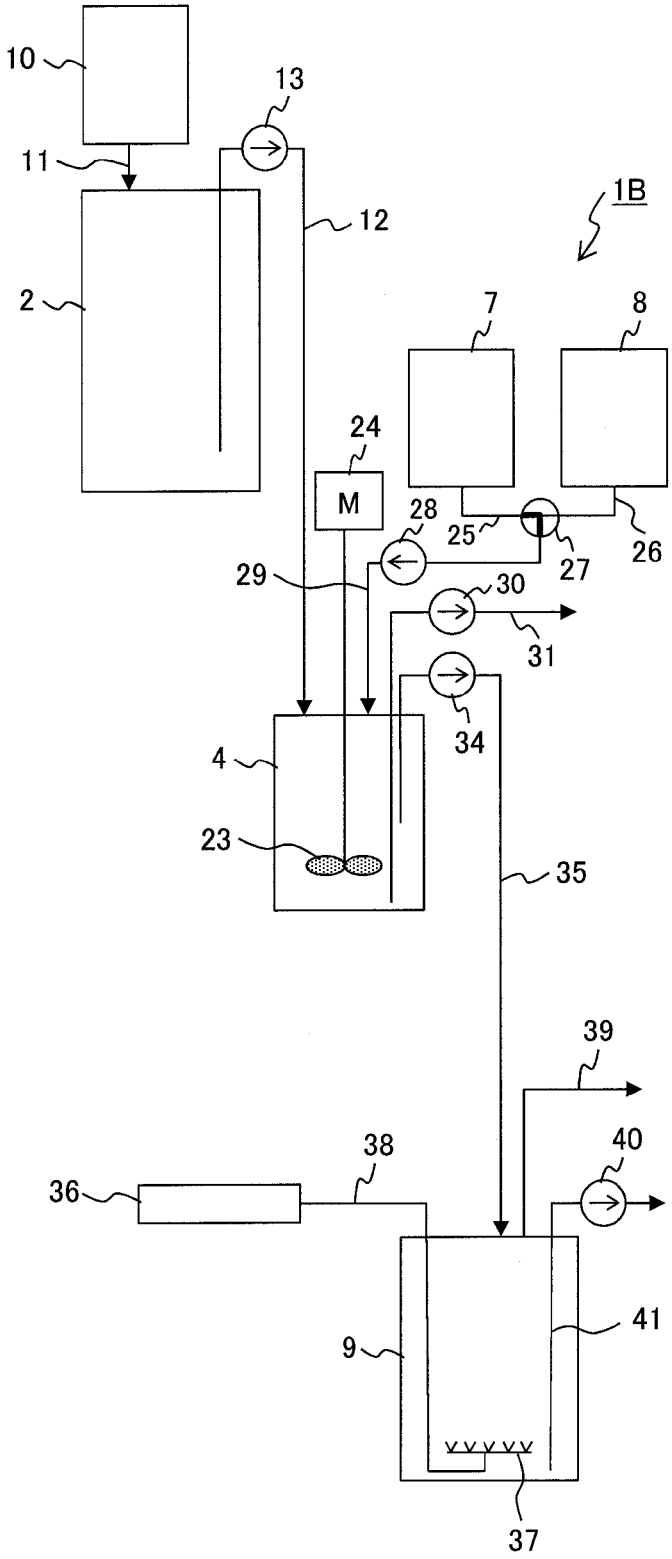
FIG. 4 is a schematic diagram illustrating a radioactive organic waste treatment system according to Third Embodiment.

FIG. 4 illustrates a radioactive organic waste treatment system for use in the present embodiment.

The radioactive organic waste generated in the pressurized water nuclear power plant does not include crud such as iron oxide, unlike the radioactive organic waste generated in the boiling water nuclear power plant. The treatment for the radioactive organic waste generated in the pressurized water nuclear power plant does not require the first cleaning step S51 for dissolving crud using an organic acid aqueous solution.

The radioactive organic waste treatment system 1B is used for the radioactive organic waste treatment according to the present embodiment so as to treat the radioactive organic waste generated in the pressurized water nuclear power plant. As illustrated in FIG. 4, the system 1B corresponds to the radioactive organic waste treatment system 1 in FIG. 1, except for not employing the first cleaning tank 3, the organic acid tank 5, the transfer water tank 6, the transfer pumps 19, 21, and 32, the liquid supply pipe 20, and the organic waste transfer pipes 22 and 33; and except for connecting the second cleaning tank (hereinafter also simply referred to as "cleaning tank") 4 to the organic waste supply pipe 12. The other configurations of the radioactive organic waste treatment system 1B are as with the radioactive organic waste treatment system 1 in FIG. 1.

The radioactive organic waste generated in the pressurized water nuclear power plant is stored in the high-dose resin storage tank 2. The radioactive organic waste is supplied from the high-dose resin storage tank 2 through the organic waste supply pipe 12 to the cleaning tank 4 and undergoes the radioactive organic waste treatment method according to the present embodiment. The method according to the present embodiment subjects the radioactive organic waste not to the first cleaning step S51 as in First Embodiment, but to the second cleaning step S53; and subjects a waste liquid generated in the second cleaning step S53 to the cleaning waste liquid treatment step S52. Slurry containing the radioactive organic waste is supplied to the cleaning tank 4, and water in the cleaning tank 4 is discharged to the cleaning waste liquid treatment tank 9. An organic acid salt aqueous solution such as an ammonium formate aqueous solution is then supplied from the organic acid salt tank 7 into the cleaning tank 4. The radioactive organic waste in the cleaning tank 4 is immersed in the ammonium formate aqueous solution for 2 hours. The radioactive organic waste includes a cation exchange resin adsorbing radionuclide ions. The adsorbed radionuclide ions are exchanged with ammonium ion in the ammonium formate aqueous solution and thereby desorbed from the cation exchange resin into the ammonium formate aqueous solution.

After the completion of the second decontamination step (second cleaning step) for 2 hours, the ammonium formate aqueous solution is discharged from the cleaning tank 4 to the cleaning waste liquid treatment tank 9. The cleaning waste liquid treatment step S52 is performed in the cleaning waste liquid treatment tank 9 by supplying ozone to the ammonium formate aqueous solution to decompose ammonium formate into nitrogen gas, carbon dioxide gas, and water. After the completion of the cleaning waste liquid treatment step S52, a radioactive waste liquid may be discharged from the cleaning waste liquid treatment tank 9, powdered typically with a thin film dryer, housed in a metal drum, and solidified with cement. The radioactive waste liquid may also be concentrated by heating, housed in a metal drum, and solidified with cement.

The method according to the present embodiment treats the radioactive organic waste with an organic acid salt aqueous solution such as an ammonium formate aqueous solution. As in First Embodiment, the use of ammonium formate aqueous solution enables the desorption of adsorbed radionuclide ions from the cation exchange resin in a larger amount than that of the technique disclosed in Patent Document 6 where adsorbed radionuclide ions are desorbed from a cation exchange resin by the action of an organic acid aqueous solution (e.g., an oxalic acid aqueous solution). The method can still reduce the concentration of radionuclides in a radioactive organic waste typified by a cation exchange resin and can reduce the amount of a high-dose radioactive waste (amount of the cation exchange resin adsorbing radionuclide ions). Here, radionuclide ions adsorbed by an anion exchange resin can be removed by an oxalate ion contained in the oxalic acid aqueous solution. And the radionuclide ions can be removed by the formate ion contained in the ammonium formate aqueous solution. In addition, the method employs the oxidization treatment to decompose organic components in the cleaning waste liquid and employs the concentration or dry powdering of the residual waste liquid. The organic components are exemplified by oxalic acid contained in the oxalic acid aqueous solution; and ammonium formate contained in the ammonium formate aqueous solution. The method can thereby still reduce the amount of a high-dose radioactive waste.

The radioactive organic waste treatment system 1B for use in the present embodiment can have a smaller size than that of the radioactive organic waste treatment system 1. This is because the system 1B does not require the facilities such as the first cleaning tank 3 and the organic acid tank 5 to be arranged in the radioactive organic waste treatment system 1, as described above.

How to reduce the amount of a cleaning agent for use in chemical cleaning of an organic waste generated from nuclear facilities will be illustrated.

Figure 5:
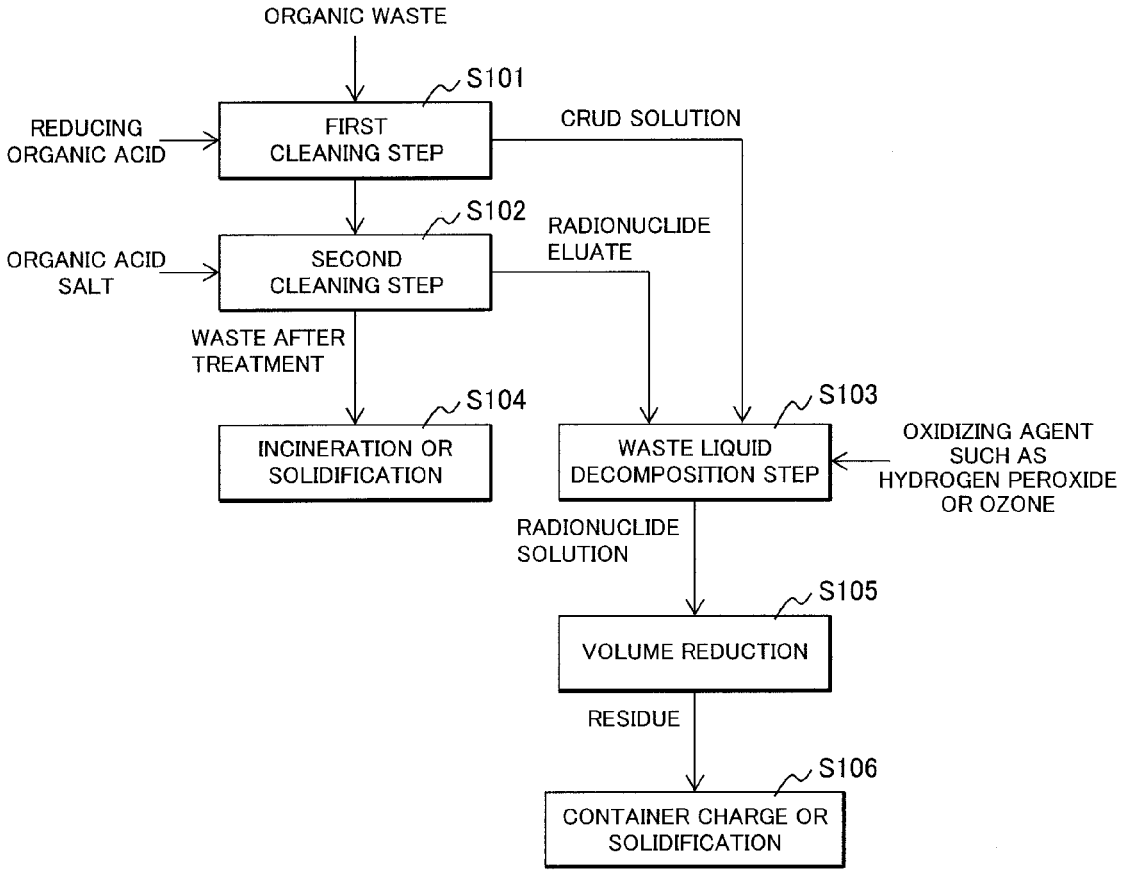
FIG. 5 is a flow chart schematically illustrating an organic waste treatment method.

FIG. 5 is a flow chart schematically illustrating a treatment method for an organic waste such as a spent ion exchange resin or filter sludge.

The organic waste treatment method illustrated in FIG. 5 includes a first cleaning step S101, a second cleaning step S102, and a waste liquid decomposition step S103. The first cleaning step S101 decomposes crud with an aqueous solution of a reducing organic acid, where the crud is deposited on the organic waste. The second cleaning step S102 is performed after the step S101 and elutes adsorbed radioactive metal ions from the organic waste using an organic acid salt aqueous solution. The waste liquid decomposition step S103 decomposes organic substances by heat or an oxidizing agent such as hydrogen peroxide or ozone, where the organic substances are contained in a crud solution and a radionuclide eluate generated in the first cleaning step S101 and the second cleaning step S102, respectively.

The first cleaning step S101 is performed in order to dissolve and remove radionuclides such as Co-60 (cobalt-60) together with the crud by the action of the reducing organic acid aqueous solution, where the radionuclides are incorporated in the crud deposited on the organic waste. In addition, the step is expected to advantageously elute part of adsorbed radioactive metal ions from the ion exchange resin.

The second cleaning step S102 is performed in order to efficiently elute adsorbed radioactive metal ions from the organic waste with a solution of an organic acid salt. The organic acid salt for use herein is desirably one that forms an ion having ion selectivity for the organic waste higher than those of hydrogen ion and the organic acid ion; or forms an ion capable of forming a stable complex with a radioactive metal ion adsorbed by the organic waste. In an embodiment, a non-volatile ion may be added in an amount approximately corresponding to the ion exchange capacity of the ion exchange resin. This enables still efficient elution of the radioactive metal ions. Here, the ion having the ion selectivity for the organic waste higher than those of the hydrogen ion is typically hydrazine ion. The organic acid ion is typically oxalate ion. Further, the ion having the ion selectivity for the organic waste higher than those of the oxalate ion is formate ion or carbonate ion, for example. Furthermore, the ion capable of forming the stable complex is typically oxalate ion or citrate ion.

The organic acid and organic acid salt for use in embodiments of the present invention preferably include at least one element selected typically from carbon, hydrogen, oxygen, nitrogen and do not give a non-volatile residue in a waste liquid after oxidization decomposition or thermal decomposition of the cleaning waste liquid. The organic acid is exemplified by oxalic acid and citric acid. The organic acid salt is exemplified by hydrazine salts of oxalic acid, citric acid, formic acid, carbonic acid, and acetic acid. The organic acid salt is preferably hydrazine oxalate or hydrazine citrate which includes an organic acid having reducibility.

The non-volatile ion may be added to the organic acid salt in an amount corresponding approximately to the ion exchange capacity of the ion exchange resin. The non-volatile ion is added in an amount of less than 1% of the resin organic waste amount and may probably not substantially affect the volume reduction of the resulting waste. The non-volatile ion is exemplified by potassium ion, zinc ion, calcium ion, and cobalt ion.

The second cleaning step S102 elutes the adsorbed radioactive metal ions from the organic waste by the action of the organic acid salt and thereafter gives a waste. The waste is subjected to incineration or solidification (S104). The waste liquid decomposition step S103 decomposes the organic substances in the crud solution and radionuclide eluate and thereafter gives a radionuclide solution. The radionuclide solution is subjected to volume reduction (S105), and the residue of which is charged into a container or solidified (S106). Here, the volume reduction (S105) is carried out by a concentration process or a dry powdering process.

The treatment method according to the present embodiment basically includes the steps as mentioned above, but may be modified as follows. Initially, the first cleaning step S101 and the second cleaning step S102 may be performed step by step in an identical cleaning tank (facilities in the same block).

The organic waste may be heated during the first cleaning step S101 and the second cleaning step S102. The solutions of the organic acid and organic acid salt may be supplied continuously or intermittently in the two steps during the immersion treatment of the organic waste in the solutions of the organic acid and organic acid salt, respectively.

The first cleaning step S101 can be omitted when the organic waste includes substantially no crud such as iron oxide. The first cleaning step S101 can also be omitted when the second cleaning step S102 employs an organic acid salt capable of dissolving the crud.

Independently, the second cleaning step S102 can be omitted when the first cleaning step S101 employs an organic acid capable of efficiently eluting adsorbed radioactive metal ions from the organic waste.

The first cleaning step S101 and the second cleaning step S102 generate a crud solution and a radionuclide eluate, respectively. The crud solution and the radionuclide eluate may be subjected to the waste liquid decomposition step S103 in an identical tank (facilities of the same block) at different times or simultaneously.

Fourth Embodiment

Figure 6:
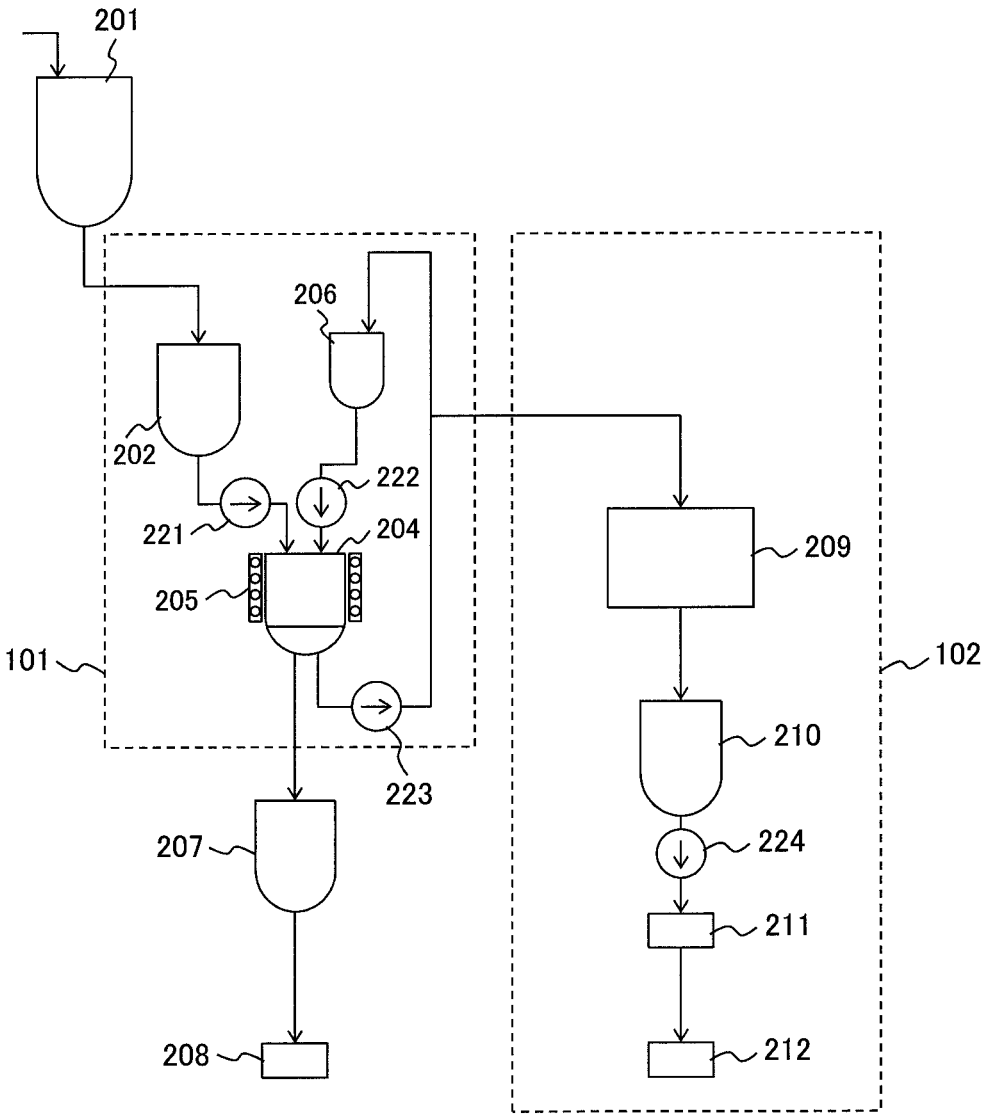
FIG. 6 is a diagram illustrating an organic waste treatment system according to Fourth Embodiment.

FIG. 6 illustrates an organic waste treatment system according to Fourth Embodiment.

The treatment system in FIG. 6 includes a chemical cleaning unit 101 that treats an organic waste; and a waste liquid decomposing unit 102 that treats a cleaning waste liquid. A first cleaning step S101 and a second cleaning step S102 are performed in the chemical cleaning unit 101 (facilities of the same block). The first cleaning step S101 dissolves crud; whereas the second cleaning step S102 elutes radioactive metal ions from the organic waste.

The chemical cleaning unit 101 includes a first receiver tank 202, a chemical reaction tank 204, and a cleaning liquid supply tank 206. The waste liquid decomposing unit 102 includes an ozone decomposition system 209, a treated water collection tank 210, a dry powdering system 211, and a solidification system 212.

A chemical cleaning organic waste is stored in an organic waste storage tank 201. Slurry containing about 10 percent by weight of the organic waste is drawn from the organic waste storage tank 201 and transferred in a predetermined amount to the first receiver tank 202 in the chemical cleaning unit 101. The organic waste is then transferred by a transfer pump 221 to the chemical reaction tank 204. An oxalic acid aqueous solution is supplied in an amount of about 72 g/L from the cleaning liquid supply tank 206 to the transferred organic waste in the chemical reaction tank 204 by a transfer pump 222. Thus, the dissolution treatment of crud deposited on the organic waste is performed in the chemical reaction tank 204. Oxalic acid is used herein as an exemplary organic acid.

The oxalic acid solution to be supplied from the cleaning liquid supply tank 206 to the chemical reaction tank 204 may be a saturated solution and have a concentration of about 0.8 mol/L. An aqueous citric acid solution may be used instead of the oxalic acid aqueous solution. The organic acids have reducibility. Temperature control equipment 205 is arranged so as to heat the chemical reaction tank 204. The heating may be performed to a temperature of lower than 100° C.

In an embodiment, oxalic acid alone may be collected by precipitating a crud contained in a crud solution generated in the treatment and thereafter separating its supernatant liquid etc., and the collected oxalic acid may be transferred to the cleaning liquid supply tank 206 by a transfer pump 223 and reused in the crud dissolution. The ultimately generated crud solution is handled as a cleaning waste liquid and transferred to the ozone decomposition system 209 in the waste liquid decomposing unit 102.

A hydrazine formate aqueous solution is continuously supplied in an amount of about 40 to about 400 g/L from the cleaning liquid supply tank 206 to the residual organic waste after crud dissolution in the chemical reaction tank 204. Thus, an elution treatment of adsorbed radioactive metal ions from the organic waste is performed. The hydrazine formate aqueous solution for use herein may be a neutral solution having a pH of about 7. Here, concentration of the hydrazine formate aqueous solution is a mass of its solute (the hydrazine formate) per 1 liter of the aqueous solution.

The treatment generates a radionuclide eluate. In an embodiment, the hydrazine formate aqueous solution alone may be collected from the radionuclide eluate, and the collected hydrazine formate aqueous solution may be transferred to the cleaning liquid supply tank 206 and reused in the elution of radioactive metal ions. A hydrazine salt of oxalic acid, acetic acid, or citric acid may be used herein instead of hydrazine formate. The ultimately generated radionuclide eluate is handled as a cleaning waste liquid and transferred to the ozone decomposition system 209.

When performed with respect to Co-60 adsorbed by the organic waste, the decontamination process (cleaning process) offers a decontamination performance in terms of decontamination factor DF of about 4 when employing oxalic acid as the cleaning agent; and offers better decontamination performance in terms of a DF of 20 or more when employing the hydrazine formate as the cleaning agent. It is necessary to add the oxalic acid many times in order to obtain the DF of 20 or more when employing only the oxalic acid as the cleaning agent. On the other hand, it is not necessary to add the hydrazine formate many times when employing the hydrazine formate as the cleaning agent. Thus, it is possible to decrease the amount used of the cleaning agent. As used herein the term "decontamination factor DF" refers to a numerical value as determined by dividing the counting rate before decontamination by the counting rate after decontamination. In addition, the decontamination process (an ion elution) employing the hydrazine formate is carried out after the decontamination process (a crud dissolution) employing oxalic acid. Thus, the ion elution is not carried out when employing oxalic acid as the cleaning agent. Therefore, the term "decontamination factor DF" refers to a numerical value as determined by dividing the counting rate before the decontamination by the counting rate after decontamination of only the crud dissolution. On the other hand, when the ion solute is carried out, the term "decontamination factor DF" refers to a numerical value as determined by dividing the counting rate before the decontamination by the counting rate after decontamination of the crud dissolution and the ion solute.

The organic waste after the cleaning is drawn as slurry by weight from the chemical reaction tank 204 and transferred to a second receiver tank 207, where the slurry has an organic waste concentration of about 10 percent. The organic waste is transferred in a certain amount to an incineration system or cement solidification system 208 and is incinerated or solidified with cement.

Oxalic acid and hydrazine formate contained in the cleaning waste liquid transferred to the ozone decomposition system 209 are decomposed typically into carbon dioxide, nitrogen, and water by ozone decomposition. This converts organic substances in the cleaning waste liquid into inorganic substances and allows solids components in the waste liquid to be crud, eluted radioactive metal ions, and other salts.

A radionuclide solution formed by ozone decomposition is collected into the treated water collection tank 210, transferred in a certain amount to the condensation system or dry powdering system 211 by a pump 224, and is subjected to a concentration or dry powdering treatment.

The resulting residue is transferred to the container filling system or solidification system 212 and stored as filled in the container. The residue may be solidified with cement or another solidification agent.

Fifth Embodiment

Figure 7:
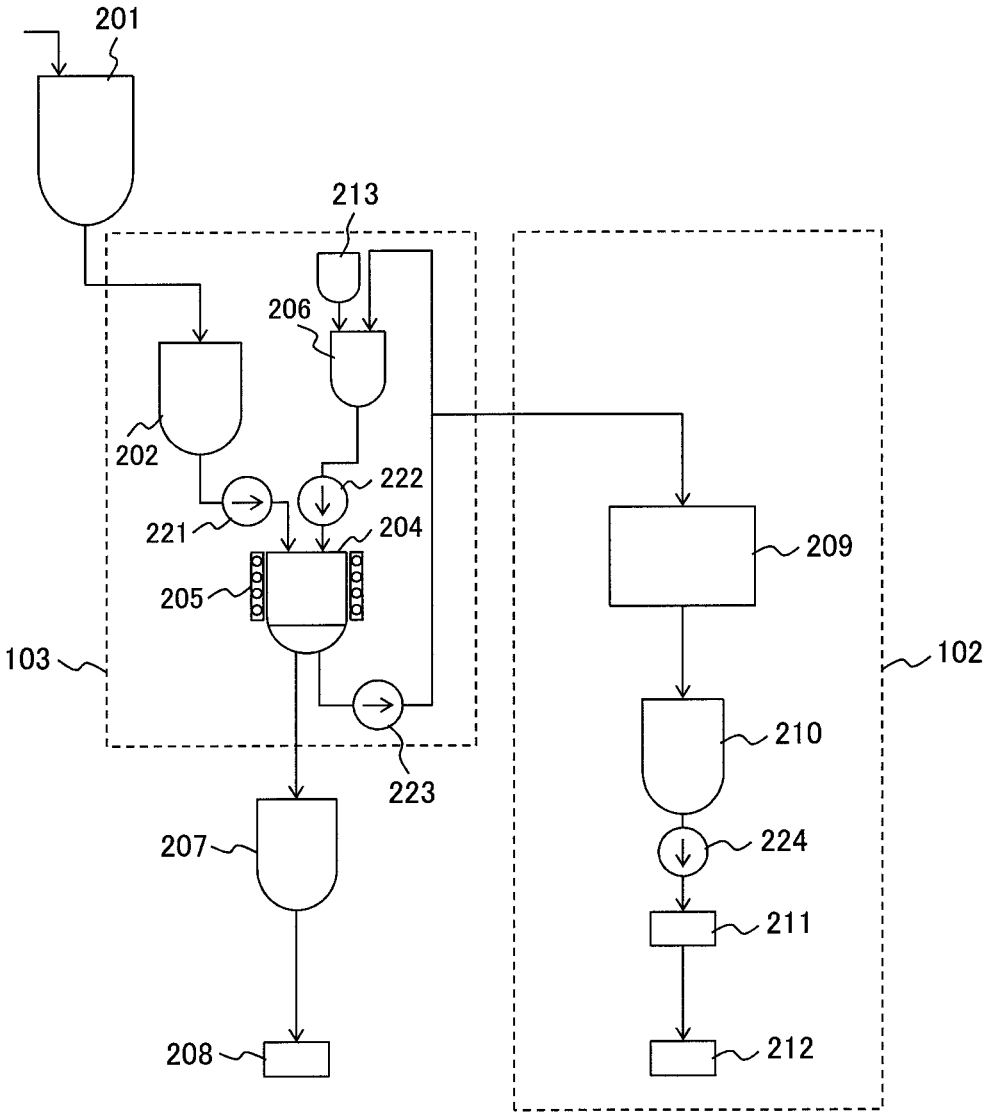
FIG. 7 is a diagram illustrating an organic waste treatment system according to Fifth Embodiment.

FIG. 7 illustrates an organic waste treatment system according to Fifth Embodiment.

The treatment system in FIG. 7 includes a chemical cleaning unit 103 that supplies a cleaning liquid containing a non-volatile ion to an organic waste; and a waste liquid decomposing unit 102 that treats a cleaning waste liquid. Using the treatment system, the first cleaning step S101 and the second cleaning step S102 are performed in the same block as in Fourth Embodiment.

The organic waste is drawn as slurry from the organic waste storage tank 201, transferred to the first receiver tank 202, and transferred to the chemical reaction tank 204 by a pump 221. An oxalic acid solution is fed to the chemical reaction tank 204, followed by crud dissolution. The concentration and amount of the oxalic acid solution, and the temperature in the process are as in Fourth Embodiment.

After the crud dissolution, cobalt (as ion) is fed from non-volatile ion supply tank 213 (non-volatile ion storage tank) and added to hydrazine formate for use in the elution of radioactive metal ions. The cobalt (ion) is added in an amount corresponding to about 3 meq/L of the ion exchange capacity of the organic waste to be treated. The resulting mixture is supplied as an eluent to the chemical reaction tank 204, followed by elution of radioactive metal ions. The eluent for use herein may be a neutral liquid having a pH of 7 and may be supplied in an amount as in Fourth Embodiment. The treatment method according to the present embodiment offers decontamination performance with respect to Co-60 in terms of a DF of 1000 or more, indicating significantly better decontamination performance than that in Fourth Embodiment. Equivalent or better decontamination performance can be obtained by using an aqueous solution containing potassium ion, zinc ion or calcium ion instead of cobalt ion (an aqueous solution of cobalt sulfate, cobalt nitrate or cobalt chloride) to be added to hydrazine formate.

A cleaning waste liquid generated in the chemical cleaning unit 103 is transferred to the ozone decomposition system 209 and is treated as in Fourth Embodiment.

What is claimed is:

1. A method for treating a radioactive organic waste, the radioactive organic waste including a cation exchange resin adsorbing radionuclide ions, the method comprising the step of:

an organic acid salt treatment process bringing the radioactive organic waste into contact with an organic acid salt aqueous solution containing an organic acid salt and whereby desorbing the radionuclide ions from the cation exchange resin, wherein the organic acid salt contained in the organic acid salt aqueous solution includes a cation that is more readily adsorbable by the cation exchange resin than hydrogen ion is.

2. The method according to claim 1, further comprising the step of:

an organic acid salt oxidization treatment process subjecting the organic acid salt aqueous solution after the step of desorbing to an oxidization treatment and whereby decomposing the organic acid salt, the organic acid salt aqueous solution containing the radionuclide ions desorbed from the cation exchange resin.

3. The method according to claim 1, when the radioactive organic waste includes an iron oxide, the method further comprising the step of:

an organic acid treatment process bringing the radioactive organic waste into contact with an organic acid aqueous solution and whereby dissolving the iron oxide before the step of the organic acid salt treatment process.

4. The method according to claim 3, further comprising the step of:

an organic acid oxidization treatment process subjecting the organic acid aqueous solution to an oxidization treatment and whereby decomposing the organic acid contained in the organic acid aqueous solution after the step of the organic acid treatment process.

5. The method according to claim 3, wherein the radioactive organic waste is brought into contact with the organic acid aqueous solution in a cleaning tank;

the organic acid aqueous solution is discharged from the cleaning tank after the contact; and the organic acid salt aqueous solution is supplied after the discharge into the cleaning tank storing the radioactive organic waste so as to bring the radioactive organic waste into contact with the organic acid salt aqueous solution.

6. The method according to claim 3, wherein the organic acid salt aqueous solution includes a substance prepared by adding a basic aqueous solution to the organic acid aqueous solution after the dissolution of the iron oxide and whereby neutralizing the organic acid aqueous solution.

7. The method according to claim 1, wherein the organic acid salt is a salt selected from the group consisting of ammonium salt, barium salt and cesium salt of an acid selected from the group consisting of oxalic acid, formic acid, carbonic acid, acetic acid and citric acid.

8. The method according to claim 3, wherein the organic acid is selected from the group consisting of oxalic acid, formic acid, carbonic acid, acetic acid and citric acid.

9. The method according to claim 3, comprising both the organic acid treatment process and the organic acid salt treatment process, wherein the organic acid treatment process and the organic acid salt treatment process are performed with heating of the radioactive organic waste.

10. The method according to claim 3, comprising both the organic acid treatment process and the organic acid salt treatment process, wherein the organic acid treatment process and the organic acid salt treatment process are performed step by step in an identical cleaning tank.

11. The method according to claim 3, wherein the organic acid aqueous solution for use in the organic acid treatment process includes an organic acid including at least one element selected from the group consisting of carbon, oxygen, hydrogen and nitrogen.

12. The method according to claim 1, wherein the organic acid salt aqueous solution for use in the organic acid salt treatment process includes an organic acid salt with an anion, the anion including at least one element selected from the group consisting of carbon, oxygen, hydrogen and nitrogen.

13. The method according to claim 1, wherein the organic acid salt for use in the organic acid salt treatment process is added with a non-volatile ion having a selectivity for the radioactive organic waste higher than that of hydrogen ion.

14. The method according to claim 13, wherein the non-volatile ion is at least one selected from the group consisting of potassium ion, zinc ion, calcium ion and cobalt ion.

15. The method according to claim 3, wherein the organic acid treatment process is not performed when the radioactive organic waste includes substantially no crud, or when the organic acid salt for use in the organic acid salt treatment process is capable of dissolving crud.

16. The method according to claim 3, wherein the organic acid salt treatment process is not performed when the organic acid aqueous solution for use in the organic acid treatment process is capable of efficiently eluting radioactive metal ions adsorbed by the radioactive organic waste.

* * * * *